US008296961B2

(12) United States Patent
Nakayoshi et al.

(10) Patent No.: US 8,296,961 B2
(45) Date of Patent: Oct. 30, 2012

(54) POLISHING PAD THICKNESS MEASURING METHOD AND POLISHING PAD THICKNESS MEASURING DEVICE

(75) Inventors: Yuichi Nakayoshi, Tokyo (JP); Hiroshi Takai, Tokyo (JP); Hironori Nishimura, Tokyo (JP)

(73) Assignee: Sumco Corporation, Tokyo (JP)

( * ) Notice: Subject to any disclaimer, the term of this patent is extended or adjusted under 35 U.S.C. 154(b) by 534 days.

(21) Appl. No.: 12/694,742

(22) Filed: Jan. 27, 2010

(65) Prior Publication Data

US 2010/0197197 A1 Aug. 5, 2010

(30) Foreign Application Priority Data

Feb. 2, 2009 (JP) ..... 2009-021594

(51) Int. Cl.
*G01B 3/20* (2006.01)
*B24B 49/02* (2006.01)

(52) U.S. Cl. ..... 33/501.02; 451/5; 451/8

(58) Field of Classification Search ..... 33/501.02, 33/501.03, 501.05; 451/5–10
See application file for complete search history.

(56) References Cited

U.S. PATENT DOCUMENTS 6,495,465 B2 * 12/2002 Nakayoshi et al. ..... 438/691
6,552,812 B1 * 4/2003 Xu et al. ..... 356/630
7,670,206 B2 * 3/2010 Togawa et al. ..... 451/10
7,854,646 B2 * 12/2010 Togawa et al. ..... 451/10
8,221,191 B2 * 7/2012 Matsuzaki ..... 451/5
2001/0026948 A1 * 10/2001 Nakayoshi et al. ..... 438/8
2008/0139087 A1 * 6/2008 Togawa et al. ..... 451/8
2009/0036024 A1 * 2/2009 Matsuzaki ..... 451/5
2009/0256241 A1 10/2009 Kurita et al.
2010/0112901 A1 * 5/2010 Togawa et al. ..... 451/5
2010/0197197 A1 * 8/2010 Nakayoshi et al. ..... 451/5
2012/0164917 A1 * 6/2012 Kobata et al. ..... 451/6

FOREIGN PATENT DOCUMENTS

JP 2000-249009 9/2000
JP 2002-270556 9/2002
JP 2002-337046 11/2002

OTHER PUBLICATIONS

U.S. Appl. No. 12/607,259 to Daisuke Maruoka et al., filed Oct. 28, 2009.

* cited by examiner

*Primary Examiner* — Yaritza Guadalupe-McCall
(74) *Attorney, Agent, or Firm* — Greenblum & Bernstein, P.L.C.

(57) ABSTRACT

A polishing pad thickness measuring method measures the thickness of a polishing pad attached to an upper surface of a surface plate. The polishing pad thickness measuring method measures a first distance between an upper surface of the polishing pad and a reference position on a vertical line perpendicular to the surface of the polishing pad and a second distance between an upper surface of the surface plate and the reference position on the vertical line, and calculates the thickness of the polishing pad from the difference between the first and second distances.

20 Claims, 10 Drawing Sheets

POLISHING PAD THICKNESS MEASURING METHOD AND POLISHING PAD THICKNESS MEASURING DEVICE

BACKGROUND OF THE INVENTION

1. Field of the Invention

The present invention relates to a wafer polishing apparatus, and more particularly to a method and device for measuring the thickness of a polishing pad of a wafer polishing apparatus.

2. Description of the Related Art

In recent years, the micromachining of an IC has advanced and IC patterns have been formed over multiple layers. However, there is no way to avoid that a certain degree of unevenness is generated on the surface of a layer on which patterns are formed. In the past, patterns of the next layer have been formed as they are. However, if the number of layers is increased, the unevenness is significantly generated on the surface. Therefore, it was difficult to form good patterns. Further, since the depth of focus of an exposure device is reduced due to the miniaturization of patterns, it is difficult to transfer good patterns due to some unevenness generated on the surface. For this reason, in recent years, the surface of the layer is flattened by polishing the surface after the formation of patterns, and then patterns of the next layer are formed. A wafer polishing apparatus (CMP apparatus) using chemical mechanical polishing (CMP) is used to flatten a wafer by polishing the wafer in the process for forming the IC patterns as described above.

In general, the CMP apparatus includes a polishing surface plate that polishes a wafer, and a polishing head that holds the wafer. The CMP apparatus polishes the wafer by pressing the wafer, which is held by the polishing head, against the polishing surface plate and rotating the wafer and the polishing surface plate while supplying abrasive (slurry) between the wafer and the polishing surface plate.

Here, since a polishing pad is attached to the surface of the polishing surface plate that polishes the wafer, the wafer is polished while being pressed against the polishing pad. However, since the polishing amount of the polishing pad is decreased by the clogging of the surface of the polishing pad, the dressing of the polishing pad is performed in the CMP apparatus whenever one wafer is polished or while the wafer is polished.

Meanwhile, since the surface of the polishing pad is polished by the dressing little by little, the surface profile of the polishing pad is changed and the flatness thereof gradually deteriorates. When the wafer is polished using such a polishing pad, there is a drawback that the wafer may not be flattened with high accuracy.

Accordingly, in the past, during the dressing, an operator measures the straightness of the surface of the polishing pad by a straightness measuring device and adjusts the dressing in consideration of the polishing amount obtained from the result of the measurement. Alternatively, in the case of a polishing pad with grooves, an operator measures the depth of the groove and adjusts the dressing in consideration of the polishing amount obtained from the result of the measurement.

However, in the method in which an operator manually measures the straightness of the polishing pad as in the past, there are problems in that a lot of time is required for the measurement of the straightness of the polishing pad and efficiency is poor. Further, in the case of the method in which an operator measures the depth of the groove, there are problems in that it is not possible to accurately measure the depth of the groove and it is difficult to perform dressing so as to flatten the polishing pad.

In order to solve the above-mentioned problems, as a technique in the related art, there is disclosed a technique for obtaining polishing conditions and dressing conditions based on the profile of the surface of the polishing pad that is measured by a contact type or non-contact type pad shape measuring device (see Japanese Patent Application Laid-Open Nos. 2000-249009, 2002-270556, and 2002-337046).

However, when the dressing of the polishing pad is performed, the polishing pad becomes thin. For this reason, when the surface of the polishing pad approaches the surface plate, there is a concern that the thin portion may adversely affect the polishing of the wafer. Further, if the surface plate is exposed to the surface of the pad, the wafer to be polished is damaged. Meanwhile, after a long-term use, the surface plate, which is a base of the polishing pad, is also deformed by heat or the like generated by polishing. Accordingly, it is not possible to determine whether the result of the measurement is caused by the polishing pad or the surface plate, only from the measurement of the surface profile of the polishing pad as in the related art. Further, it is difficult to foresee that the surface plate is exposed to the surface of the polishing pad. In order to determine and foresee this, it is necessary to measure the thickness of the polishing pad or the surface profile of the surface plate after separating the polishing pad from the surface plate. However, there is a problem in that a polishing pad cannot be used by being attached to the surface plate again once it is separated from the surface plate.

SUMMARY OF THE INVENTION

The present invention has been made in consideration of the problems, and an object of the invention is to provide a polishing pad thickness measuring method and a polishing pad thickness measuring device that can measure the surface profile of a surface plate and the thickness of a polishing pad in a nondestructive manner.

In order to achieve the above object, according to a first aspect of the present invention, there is provided a polishing pad thickness measuring method that measures a thickness of a polishing pad attached to an upper surface of a surface plate, the method including: measuring a first distance between an upper surface of the polishing pad and a reference position on a vertical line perpendicular to the surface of the polishing pad and a second distance between an upper surface of the surface plate and the reference position on the vertical line; and calculating the thickness of the polishing pad from a difference between the first and second distances.

According to a second aspect of the present invention, there is provided a polishing pad thickness measuring method that measures a thickness of a polishing pad attached to an upper surface of a surface plate, the method including: measuring a first distance between an upper surface of the polishing pad and a reference position on a vertical line perpendicular to the surface of the polishing pad and a second distance between an upper surface of the surface plate and the reference position on the vertical line; and calculating the thickness of the polishing pad from a difference between the first and second distances, wherein distance measurement points of the first and second distances are set above reference planes having a predetermined flatness, respectively, and distances between the reference plane and the distance measurement points are calculated as correction amounts, and the reference position is positioned at a height obtained by subtracting the corresponding correction amount from the height of each of the distance measurement points.

According to a third aspect of the present invention, the measurement of the second distance is performed by an eddy current displacement sensor.

According to a fourth aspect of the present invention, the measurement of the first and second distances is performed by setting a plurality of distance measurement points in one direction above the polishing pad.

According to a fifth aspect of the present invention, the measurement of the first and second distances is performed while distance measurement points are moved horizontally in one direction on the polishing pad.

According to a sixth aspect of the present invention, the measurement of the second distance is performed while a displacement sensor for measuring the second distance comes into contact with the upper surface of the polishing pad and is moved horizontally in one direction on the polishing pad.

Meanwhile, according to a seventh aspect of the present invention, there is provided a polishing pad thickness measuring device that measures a thickness of a polishing pad attached to an upper surface of a surface plate, the device including: a length measuring sensor which measures a first distance between an upper surface of the polishing pad and a reference position on a vertical line perpendicular to the surface of the polishing pad; a displacement sensor which measures a second distance between an upper surface of the surface plate and the reference position; a controller that is connected to the length measuring sensor and the displacement sensor and outputs signals for operating the length measuring sensor and the displacement sensor; and a calculator that is connected to the length measuring sensor and the displacement sensor and calculates the thickness of the polishing pad from a difference between the first and second distances.

According to an eighth aspect of the present invention, there is provided a polishing pad thickness measuring device that measures a thickness of a polishing pad attached to an upper surface of a surface plate, the device including: a length measuring sensor which measures a first distance between an upper surface of the polishing pad and a reference position on a vertical line perpendicular to the surface of the polishing pad; a displacement sensor which measures a second distance between an upper surface of the surface plate and the reference position; a controller that is connected to the length measuring sensor and the displacement sensor and outputs signals for operating the length measuring sensor and the displacement sensor; and a calculator that is connected to the length measuring sensor and the displacement sensor and calculates the thickness of the polishing pad from a difference between the first and second distances, wherein distance measurement points of the first and second distances are set above reference planes having a predetermined flatness, respectively, and distances between the reference plane and the distance measurement points are calculated as correction amounts, and the reference position is positioned at a height obtained by subtracting the corresponding correction amount from the height of each of the distance measurement points.

According to a ninth aspect of the present invention, the displacement sensor is an eddy current displacement sensor.

According to a tenth aspect of the present invention, a plurality of the length measuring sensors and the displacement sensors are provided in one direction above the polishing pad.

According to an eleventh aspect of the present invention, the length measuring sensor and the displacement sensor are slidably mounted on a rail that has a predetermined height in a longitudinal direction and is horizontal above the polishing pad, and the controller outputs signals that make the length measuring sensor and the displacement sensor slide, and signals that operate the length measuring sensor and the displacement sensor.

According to a twelfth aspect of the present invention, the displacement sensor measures the second distance while coming into contact with the upper surface of the polishing pad.

According to the polishing pad thickness measuring method and the polishing pad thickness measuring device of the invention, in the first and seventh aspects, the thickness of the polishing pad is calculated by the difference between the first distance (between the reference position and the upper surface of the polishing pad attached to the surface plate) and the second distance (between the reference position and the upper surface of the surface plate). Accordingly, it is possible to measure the thickness of the polishing pad in a nondestructive manner and to effectively perform dressing by using the result of the measurement.

In the second and eighth aspects, the distance measurement points of the first and second distances are set above reference planes having a predetermined flatness, respectively, and distances between the reference plane and the distance measurement points are calculated as correction amounts. The reference position is positioned at a height obtained by subtracting the corresponding correction amount from the height of each of the distance measurement points. Accordingly, the measurement of the first and second distances is based on the reference plane having a predetermined flatness. As a result, it is possible to measure the distances between the reference position and the polishing pad and the surface plate without the influence of the heights of the distance measurement points, so that it is possible to measure the thickness of the polishing pad.

In the third and ninth aspects, the measurement of the second distance is performed by an eddy current displacement sensor. Accordingly, it is possible to reliably measure the distance between the reference position and the upper surface of the surface plate made of metal, without the influence of the polishing pad that is an insulator.

In the fourth and tenth aspects, plural length measuring sensors and displacement sensors are provided in one direction above the polishing pad, so that plural distance measurement points are set. Accordingly, it is possible to easily perform measurement at plural points and to perform measurement in a short time. Further, it is possible to grasp not only the distribution of the thickness of the polishing pad in one direction but also the surface profiles of the polishing pad and the surface plate in detail by reducing the interval between the distance measurement points.

In the fifth and eleventh aspects, the first and second distances are measured while the polishing pad is scanned in one direction by the length measuring sensor and the displacement sensor. Accordingly, it is possible to grasp the distribution of the thickness of the polishing pad and the surface profiles of the polishing pad and the surface plate in detail by a set of the length measuring sensor and the displacement sensor. Therefore, it is possible to reduce the manufacturing cost.

In the sixth and twelfth aspects, the surface of the polishing pad is scanned while the displacement sensor comes into contact with the surface of the polishing pad. Accordingly, it is possible to measure the thickness of the polishing pad even though the length measuring sensor is not used.

DETAILED DESCRIPTION OF THE EMBODIMENTS

Figure 1A:
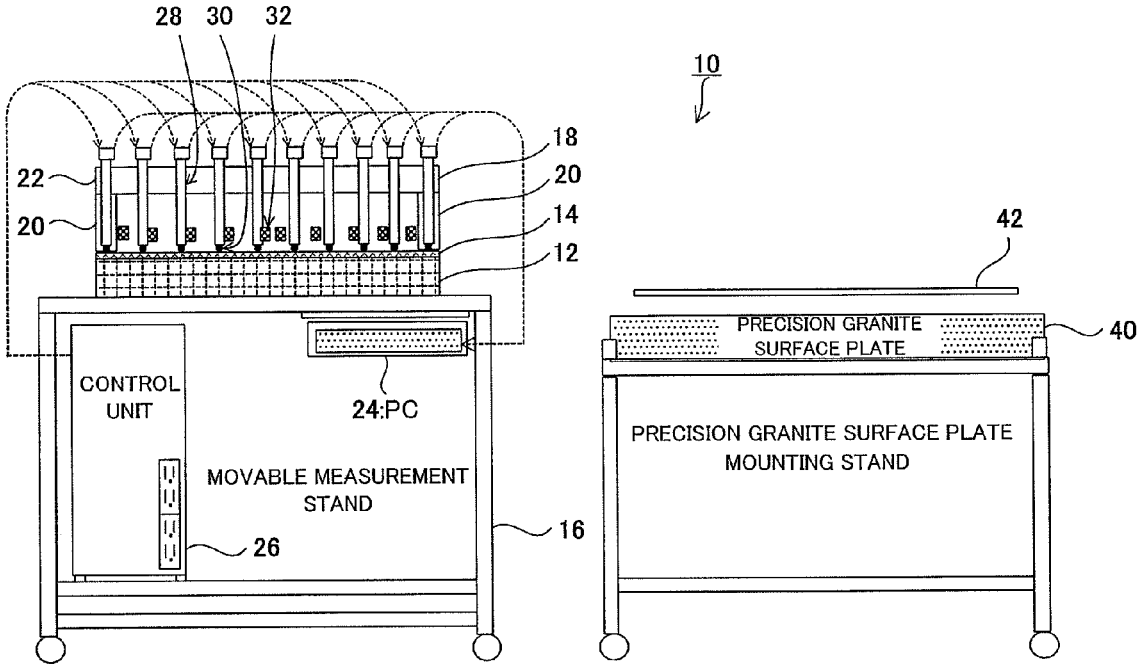
FIG. 1A is a view schematically illustrating a polishing pad thickness measuring device according to a first embodiment.

The invention will be described in detail below with reference to embodiments illustrated in the drawings. However, unless particularly specified, components, kind, combination, shape, and the relative disposition thereof described in these embodiments do not limit the scope of the invention and are merely illustrative.

FIGS. 1A, 1B, 1C, and 1D (a partial detail view of FIG. 1A) show a polishing pad thickness measuring method and a polishing pad thickness measuring device according to a first embodiment. Further, FIG. 2 illustrates a control block diagram of the polishing pad thickness measuring device. The polishing pad thickness measuring method according to the first embodiment, which measures the thickness of a polishing pad 14 attached to an upper surface of a surface plate 12, includes measuring a first distance 98 between an upper surface of the polishing pad 14 and a reference position 88 on a vertical line perpendicular to the surface of the polishing pad 14 and a second distance 100 between the reference position and an upper surface of the surface plate 12 on the vertical line, and calculating the thickness of the polishing pad 14 from the difference between the first and second distances 98 and 100. The measurement of the second distance 100 is performed by an eddy current displacement sensor 32, and plural distance measurement points 84 and 86 are set above the polishing pad 14 in one direction in order to perform the measurement of the first and second distances 98 and 100.

Accordingly, a polishing pad thickness measuring device 10 according to the first embodiment, which embodies this method, includes a support stand 18, sensor units 28 (length measuring sensors 30 and displacement sensors 32), a controller 34, and a calculator 36. Further, a stone surface plate 40 and a calibration SUS plate 42 are used as tools for the zero correction of the polishing pad thickness measuring device 10.

Figure 2:
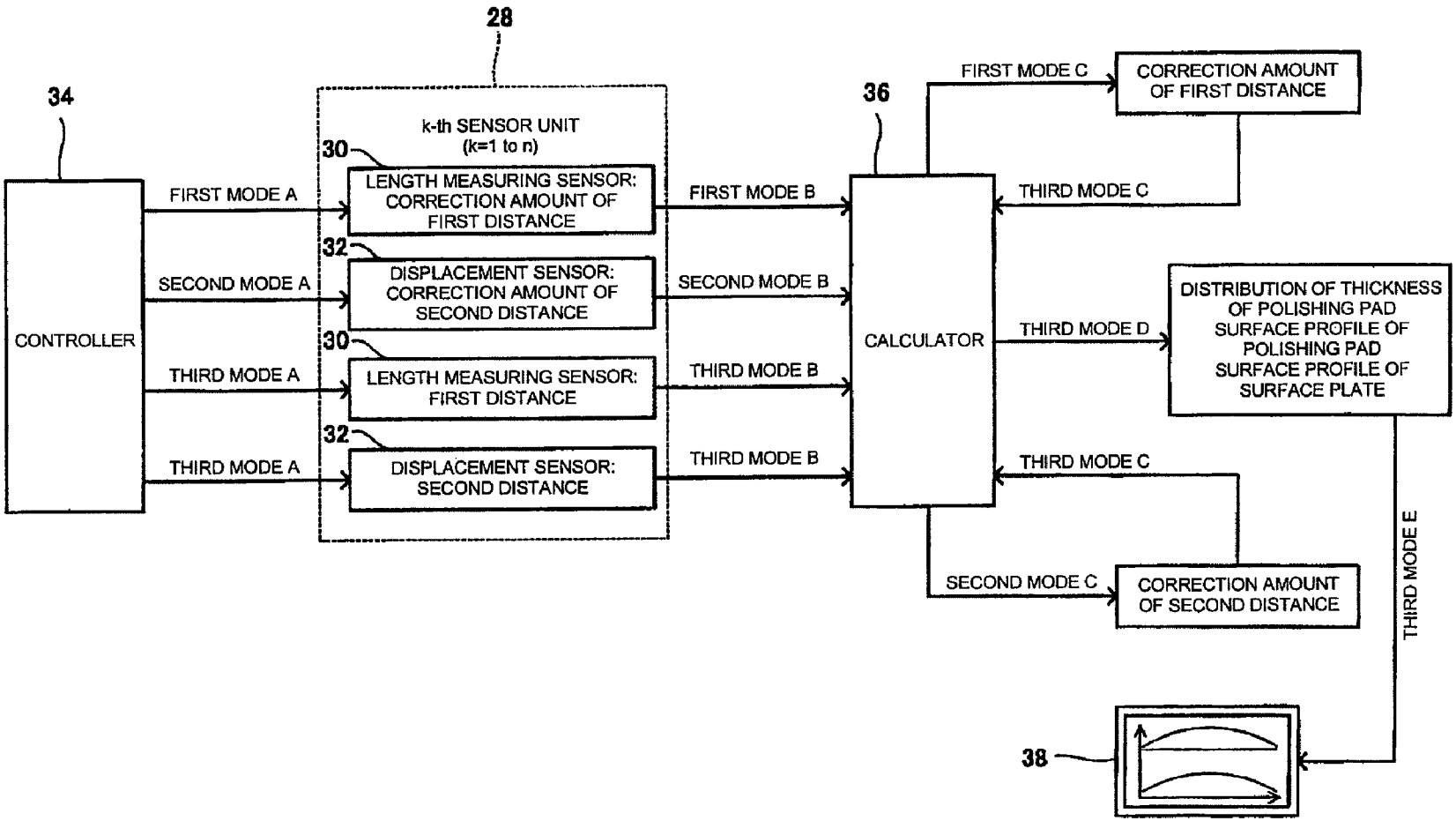
FIG. 2 is a control block diagram of the polishing pad thickness measuring device according to the first embodiment.

As shown in FIG. 1A, the polishing pad thickness measuring device 10 is to measure the thickness of the polishing pad 14, which is an insulator made of a resin or the like and is attached to a metal surface plate 12 of a semiconductor polishing apparatus by an adhesive or the like. The measurement of the thickness of the polishing pad is performed by separating the surface plate 12 from the semiconductor polishing apparatus (not shown) and placing the surface plate on a movable measurement stand 16 on which the polishing pad thickness measuring device 10 is mounted.

The support stand 18 is a rigid body that has substantially the same length as the diameter of at least the surface plate 12 and the polishing pad 14 in a longitudinal direction. The support stand 18, which includes a pair of leg parts 20 having a predetermined height and a rail part 22 connecting the leg parts 20, is placed on the polishing pad 14, and the lower ends of the leg parts 20 come into contact with the polishing pad 14. The rail part 22 is fixed to the leg parts 20 so that the longitudinal direction of the rail part 22 becomes horizontal. Further, the length measuring sensors 30 and the displacement sensors 32 are integrated into n sensor units 28 that are arranged at predetermined intervals in the longitudinal direction of the rail part 22, and are fixed so that sensor heads (not shown) face the lower side in a vertical direction.

A PC 24 is hardware that operates the entire polishing pad thickness measuring device 10, and is connected to a control unit 26, the length measuring sensors 30, and the displacement sensors 32. The PC 24 outputs signals, which operate the length measuring sensors 30 and the displacement sensor 32, to the control unit 26. Signals representing first distances 90 and signals representing second distances 94 are input to the PC from the respective sensor units 28 in serial or parallel manner.

The controller 34 is an application installed in the PC 24, and outputs signals, which operate the length measuring sensors 30 and the displacement sensors 32, to the control unit 26 while being interlocked with the operation of keys of PC.

The control unit 26 is connected to the PC 24 and the sensor units 28 (the length measuring sensors 30 and the displacement sensors 32). If signals, which operate the length measuring sensors 30 and the displacement sensors 32, are input to the control unit 26 from the PC 24, the control unit supplies electric power, which operates the length measuring sensors 30 and the displacement sensors 32, to the length measuring sensors 30 and the displacement sensors 32.

Since being connected to the control unit 26 and the PC 24, the length measuring sensors 30 output signals, which represent the first distances 90 measured from the distance measurement points 84 of the length measuring sensors 30, to the PC 24 when electric power is supplied to the length measuring sensors from the control unit 26. The length measuring sensor 30 measures the first distance 90 between the distance measurement point 84 of the length measuring sensor 30 and the upper surface of the polishing pad 14 by using time elapsed until the length measuring sensor receives reflected light after irradiating, for example, laser light to the surface of the polishing pad 14.

Since being connected to the control unit 26 and the PC 24, the displacement sensors 32 output signals, which are related to the second distances 94 measured from the distance measurement points 86 of the displacement sensors 32, to the PC 24 when electric power is supplied to the displacement sensors from the control unit 26. For example, an eddy current displacement sensor is used as the displacement sensor 32.

The displacement sensor 32 generates eddy current in the surface plate 12 by making high-frequency current flow in a coil (not shown), which is provided in a sensor head (not shown), and irradiating a high-frequency magnetic field to the surface plate 12 made of metal. Further, the impedance of the coil (not shown) is changed by the eddy current. Since the degree of change in the impedance is changed by a distance between the coil (not shown) and the surface plate 12, the second distance 94 between the coil (the distance measurement point 86) and the upper surface of the surface plate 12 is calculated from the degree of change in the impedance in the displacement sensor 32. Of course, the second distance 94 may be calculated by the calculator 36 to be described below.

The calculator 36 is an application installed in the PC 24. The calculator calculates the thickness of the polishing pad 14 from a difference between the first distance 98 of which the starting point is a reference position 88 obtained by the length measuring sensor 30 of each of the sensor units 28, and the second distance 100 of which the starting point is a reference position 88 obtained by the displacement sensor 32. Then, the calculator displays the calculation result on a display 38 of the PC 24. Further, the calculator 36 numbers the respective sensor units 28 in order to discriminate the respective sensor units 28, and the measurement position of each of the plurality of sensor units 28 (the length measuring sensors 30 and the displacement sensors 32) (on the polishing pad 14) in the longitudinal direction of the rail part 22 is input to the calculator by the operation of the keys of the PC. Furthermore, the signals, which are output from each sensor unit 28 and represent the first and second distances 90 and 94, are numbered by the same number, so that each sensor unit 28 corresponds to the first and second distances 90 and 94 that are output from each sensor unit 28.

Accordingly, the calculator 36 may display, for example, a graph, of which the horizontal axis represents the positions of the sensor units 28 (the measurement positions of the polishing pad 14) and the vertical axis represents the thickness of the polishing pad 14, on the display 38 of the PC 24. Therefore, an operator can visually recognize the distribution of the thickness of the polishing pad 14. In addition, the calculator 36 is configured to display the first and second distances 98 and 100 on the same coordinate system, so that the operator can visually recognize the surface profiles of the polishing pad 14 and the surface plate 12. Meanwhile, the number of the sensor unit 28, the measurement position of the polishing pad 14 corresponding to the number, a corrected first distance 98, a corrected second distance 100, and the thickness of the polishing pad 14 are stored as measurement data in the memory area of the PC 24 by the calculator 36. The calculator 36 may read the measurement data as needed.

Figure 1B:
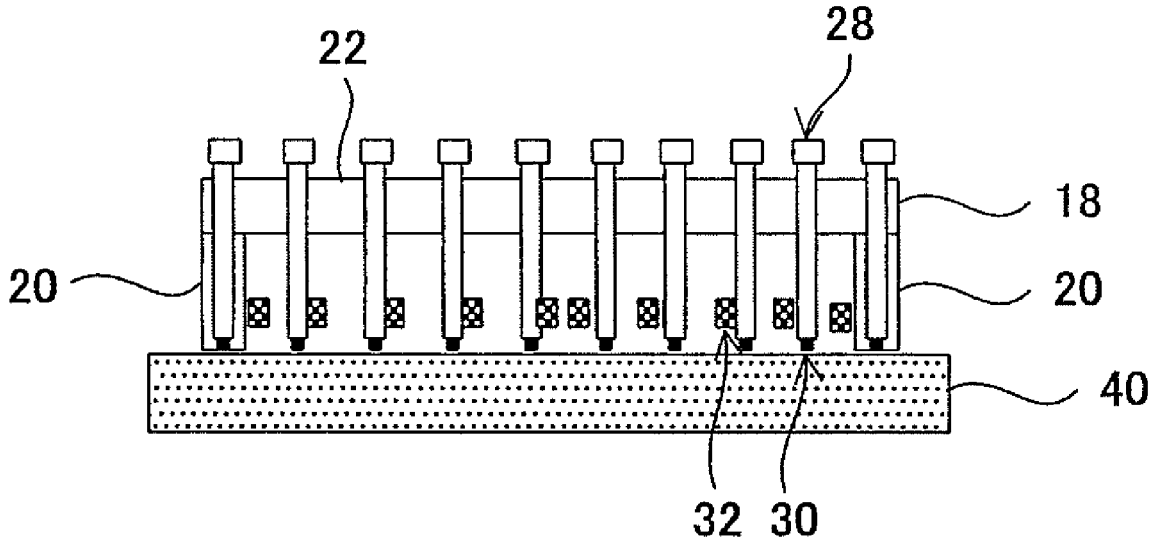
FIG. 1B is a view schematically illustrating that the polishing pad thickness measuring device according to the first embodiment is placed on a calibration SUS plate.

The stone surface plate 40 is a rigid body on which mirror polishing is performed so as to have a predetermined flatness. It is possible to measure the correction amount 92 of the first distance of each of all the length measuring sensors 30 by placing the polishing pad thickness measuring device 10 on the stone surface plate 40 as shown in FIG. 1B.

Figure 1C:
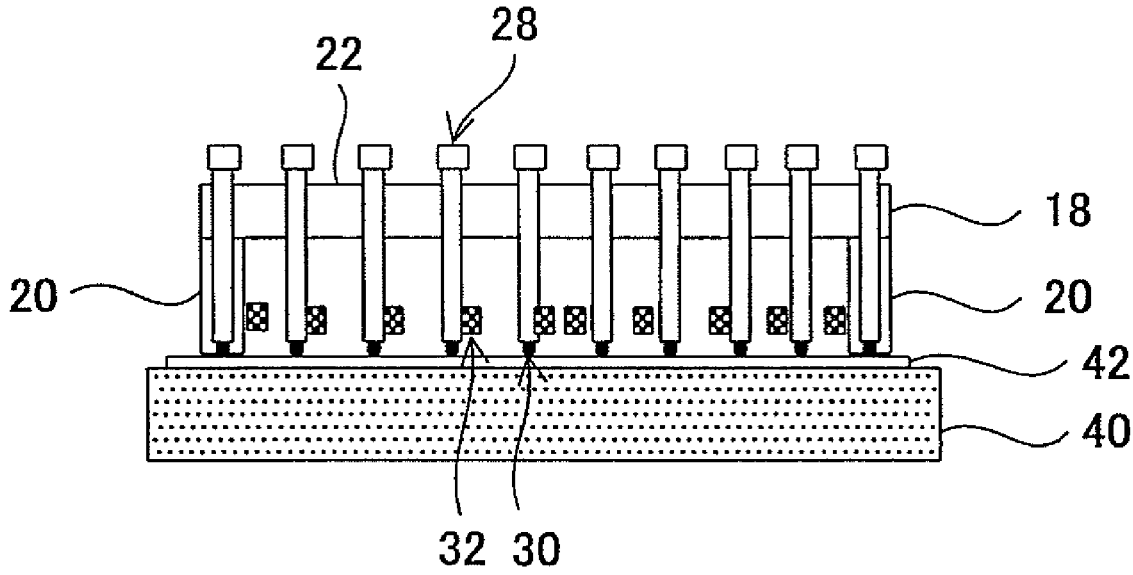
FIG. 1C is a view illustrating that the polishing pad thickness measuring device according to the first embodiment is placed on a stone surface plate.
Figure 1D:
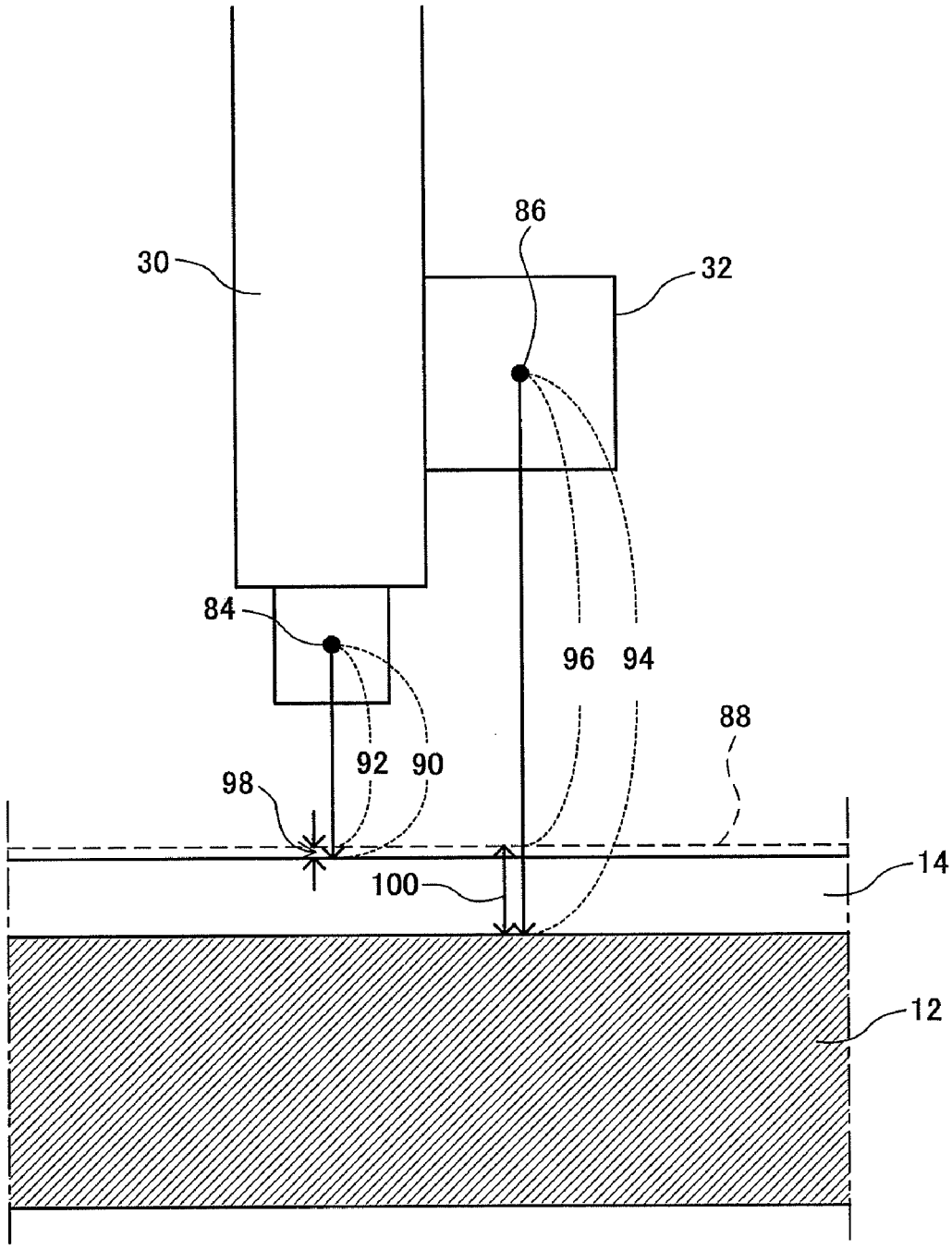
FIG. 1D is a partial detail view of FIG. 1A.

The surface of the calibration SUS plate 42 is electropolished, so that the calibration SUS plate has a predetermined flatness. When used, the calibration SUS plate is placed on the stone surface plate 40. It is possible to measure the correction amount 96 of the second distance of each of all the displacement sensors 32 by placing the polishing pad thickness measuring device 10 on the calibration SUS plate 42 as shown in FIG. 1C.

The surface of the stone surface plate 40 and the surface of the calibration SUS plate 42 serve as the reference positions 88 (reference lines or reference planes) that are used for the measurement of the first and second distances 98 and 100. Further, a distance between the stone surface plate 40 and the distance measurement point 84 of the length measuring sensor 30 is the correction amount 92 of the first distance of which an object to be measured is the stone surface plate 40, and a distance between the calibration SUS plate 42 and the distance measurement point 86 of the displacement sensor 32 is the correction amount 96 of the second distance of which an object to be measured is the calibration SUS plate 42. Meanwhile, the reference positions 88 may be positioned above or below the upper surfaces of the stone surface plate 40 and the calibration SUS plate 42. However, a case where the polishing pad thickness measuring device 10 is placed on the polishing pad 14 so that the reference positions are positioned on the normals (on the vertical lines) of the stone surface plate 40 and the calibration SUS plate 42 may be referred to as a case where the polishing pad thickness measuring device is positioned on the normal of (on the vertical line of) the surface of the polishing pad 14.

The controller 34 has a first mode that operates only the length measuring sensors 30, a second mode that operates only the displacement sensors 32, and a third mode that operates both the length measuring sensors 30 and the displacement sensors 32. These modes may be selected by the operation of the keys. The first mode is used to calculate the correction amount 92 of the first distance by placing the polishing pad thickness measuring device 10 on the stone surface plate 40, the second mode is used to calculate the correction amount 96 of the second distance by placing the calibration SUS plate 42 on the stone surface plate 40 and placing the polishing pad thickness measuring device 10 on the calibration SUS plate, and the third mode is used to measure the thickness of the polishing pad 14 and the surface profiles of the polishing pad 14 and the surface plate 12.

In association with this, if the first mode is selected, the calculator 36 stores the correction amount 92 of the first distance, of which an object to be measured is the stone surface plate 40, in the memory area of the PC 24. If the second mode is selected, the calculator stores the correction amount 96 of the second distance, of which an object to be measured is the calibration SUS plate 42, in the memory area of the PC 24. If the third mode is selected, the calculator reads the stored correction amounts 92 and 96 so as to correspond to the sensor units 28 for the first distance 90 of which an object to be measured is the polishing pad 14, and the second distance 94 of which an object to be measured is the surface plate 12, performs the correction (zero-correction) of the correction amounts, and may then calculate the thickness of the polishing pad 14.

Figure 3:
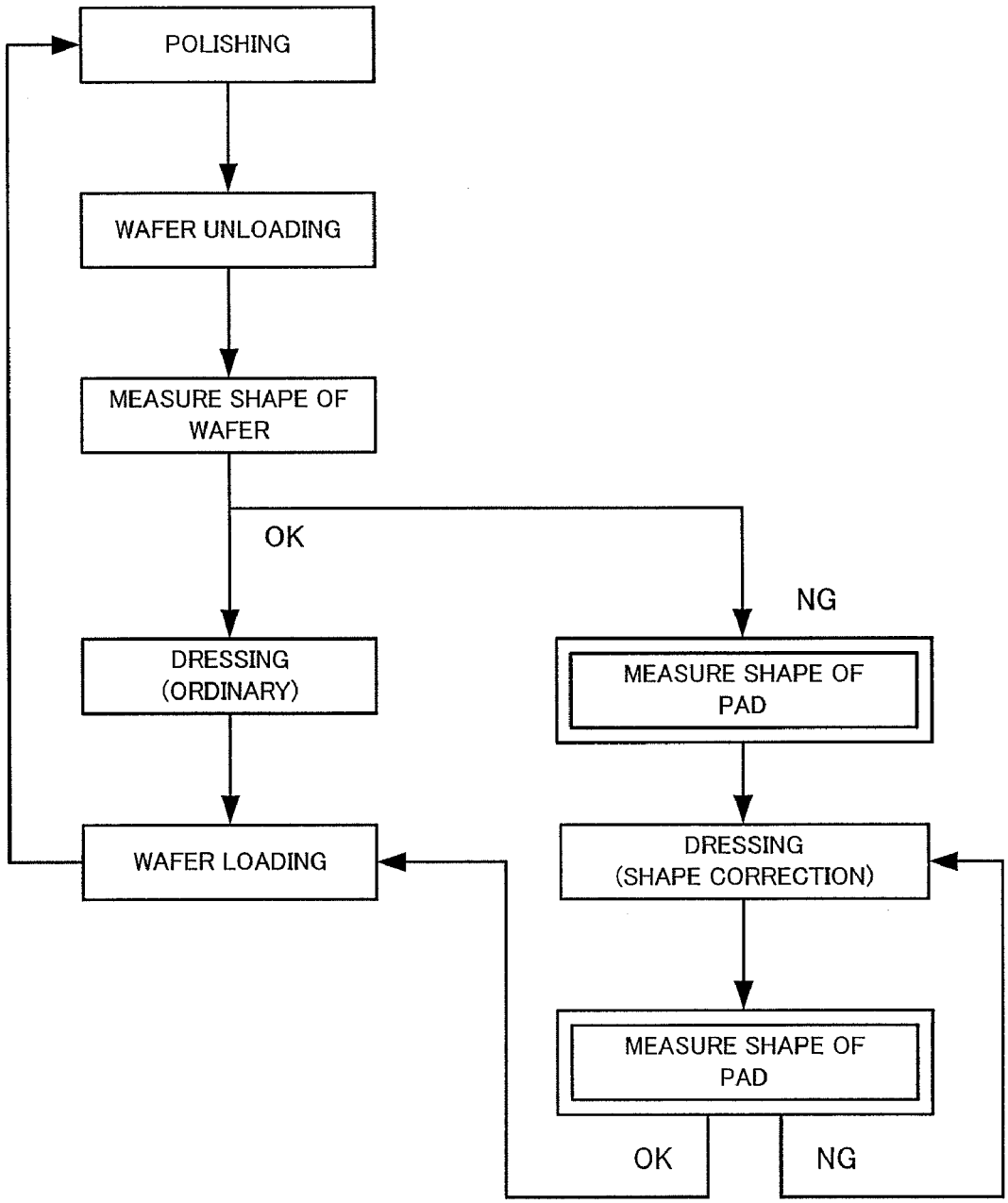
FIG. 3 is a flowchart of polishing processing, polishing pad shape measuring, and dressing of the first embodiment.

As shown in a flowchart of FIG. 3, the shape of a polished wafer is evaluated in the semiconductor polishing. Examples of an index to be evaluated include GBIR (Global Back-side Ideal Range), GFIR (Global Front Least square Range), and the like. In the case of GBIR, the flatness of the polished surface is evaluated using the bask side of the polished surface of the wafer as a reference plane. In the case of GFIR, the flatness of the polished surface is evaluated using an ideal polished surface (best fit surface), which may be estimated to have the lowest flatness on the polished surface, as a reference plane. If the result of the measurement is in an allowable range, ordinary dressing is performed on the polishing pad after polishing. However, if the result of the measurement is out of the allowable range, the polishing pad and the surface plate are measured using this embodiment, the dressing amount is weighted in a concentric direction of the polishing pad in the dressing by using the result of the measurement, it is confirmed that the polishing pad has an intended shape, and the polishing of a wafer is performed.

The operation of the polishing pad thickness measuring device 10 having the above-mentioned structure will be described (see FIG. 2). There is a variation in the heights of the plurality of length measuring sensors 30 and the displacement sensors 32 of the polishing pad thickness measuring device 10, that is, the heights of the distance measurement points 84 and 86. Accordingly, the correction amounts 92 and 96, which are used to numerically correct the first and second distances 90 and 94 to be output from the sensors, are calculated before the measurement of the thickness of the polishing pad.

First, the polishing pad thickness measuring device 10 is placed on the stone surface plate 40 as described above, and the controller 34 operates the length measuring sensor 30 corresponding to a k-th (k=1 to n) sensor unit 28 by the control unit 26 through the operation of keys (first mode A). Then, the length measuring sensor 30 measures the correction amount 92 of the first distance of which an object to be measured is the stone surface plate 40, and outputs signals, which correspond to the correction amount 92 of the first distance, to the calculator 36 (first mode B). Further, the calculator 36 stores the correction amount 92 of the first distance in the memory area of the PC 24 (first mode C).

After that, the polishing pad thickness measuring device 10 is separated from the stone surface plate 42 once, the calibration SUS plate 42 is placed on the stone surface plate 40, and the polishing pad thickness measuring device 10 is placed on the calibration SUS plate 42. Further, the controller 34 operates the displacement sensor 32 corresponding to a k-th (k=1 to n) sensor unit 28 by the control unit 26 through the operation of keys (second mode A), and the displacement sensor 32 measures the correction amount 96 of the second distance of which an object to be measured is the calibration SUS plate 42, and outputs signals, which correspond to the correction amount 96 of the second distance, to the calculator 36 (second mode B). The calculator 36 stores the correction amount 96 of the second distance in the memory area of the PC 24 (second mode C).

Then, the polishing pad 14 and the surface plate 12 are measured using the polishing pad thickness measuring device 10. First, the surface plate 12 to which the polishing pad 14 is attached is separated from the semiconductor polishing apparatus (not shown) and placed on the movable measurement stand 16, and the polishing pad thickness measuring device 10 is placed on the polishing pad 14. Further, the controller 34 operates the length measuring sensor 30 and the displacement sensor 32 corresponding to a k-th (k=1 to n) sensor unit 28 by the control unit 26 through the operation of keys (third mode A), and the length measuring sensor 30 outputs signals, which correspond to the first distance 90, to the calculator 36, and the displacement sensor 32 outputs signals, which correspond to the second distance 94, to the calculator 36 (third mode B).

The calculator 36 reads the correction amount 92 of the first distance and the correction amount 96 of the second distance from the memory area of the PC 24 (third mode C), calculates the corrected (zero-corrected) first distances 98 (second distances 100) by subtracting the correction amounts 92 (96) of the first distances (second distances) from the first distances 90 (second distances 94) corresponding to the n sensor units 28 (third mode D), obtains the distribution of the thickness of the polishing pad 14 by calculating n values of the thickness of the polishing pad 14 from the differences between the corrected first and second distances 98 and 100 of which the starting points are the reference positions 88 (third mode D), and displays both the corrected first distances 98 (the surface profile of the polishing pad 14) and the corrected second distances 100 (the surface profile of the surface plate 12) on the display 38 of the PC 24 (third mode E).

Accordingly, the operator can visually recognize the surface profiles of the polishing pad 14 and the surface plate 12 and the distribution of the thickness of the polishing pad 14. Therefore, it is possible to restore the flatness of the polishing pad 14 and the polished wafer by weighting the dressing in a concentric direction of the polishing pad 14 by using this result. In addition, it is also possible to predict the life of the polishing pad 14 by the degree of the decrease in the thickness of the polishing pad 14.

Figure 4:
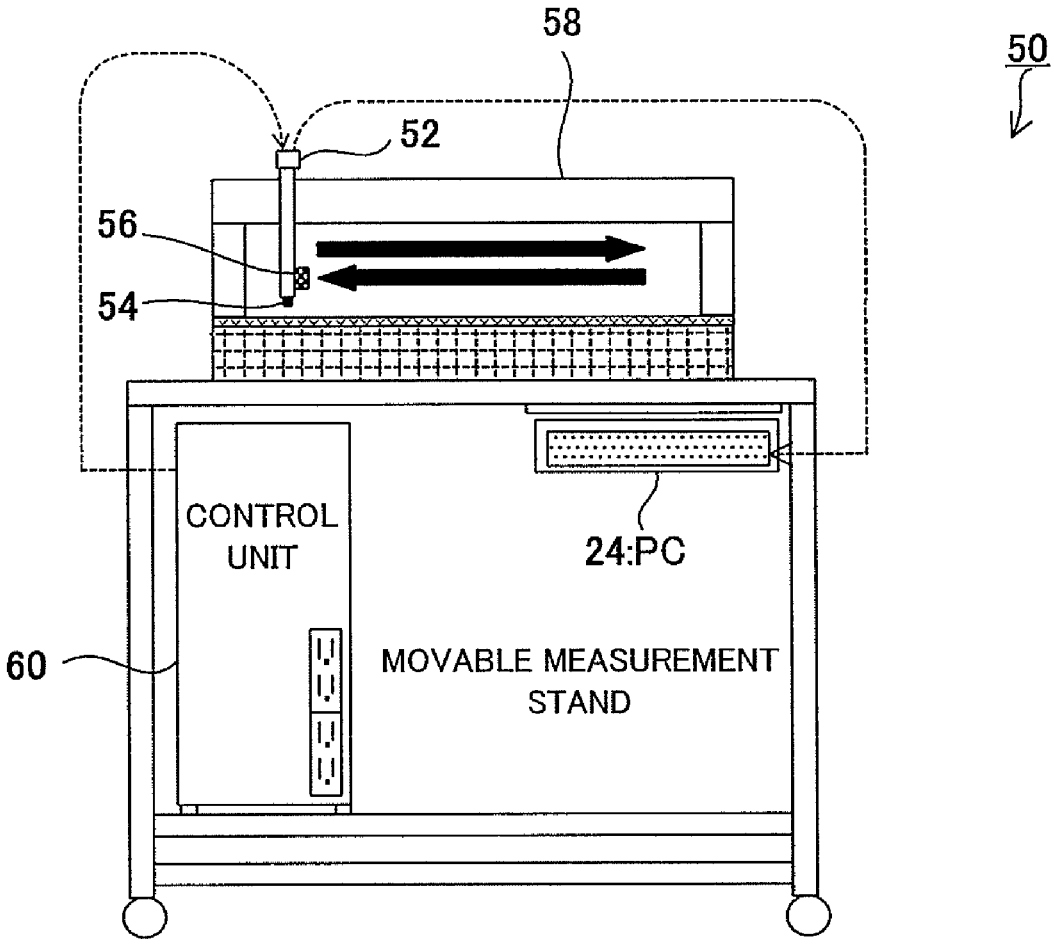
FIG. 4 is a view schematically illustrating a polishing pad thickness measuring device according to a second embodiment.
Figure 5:
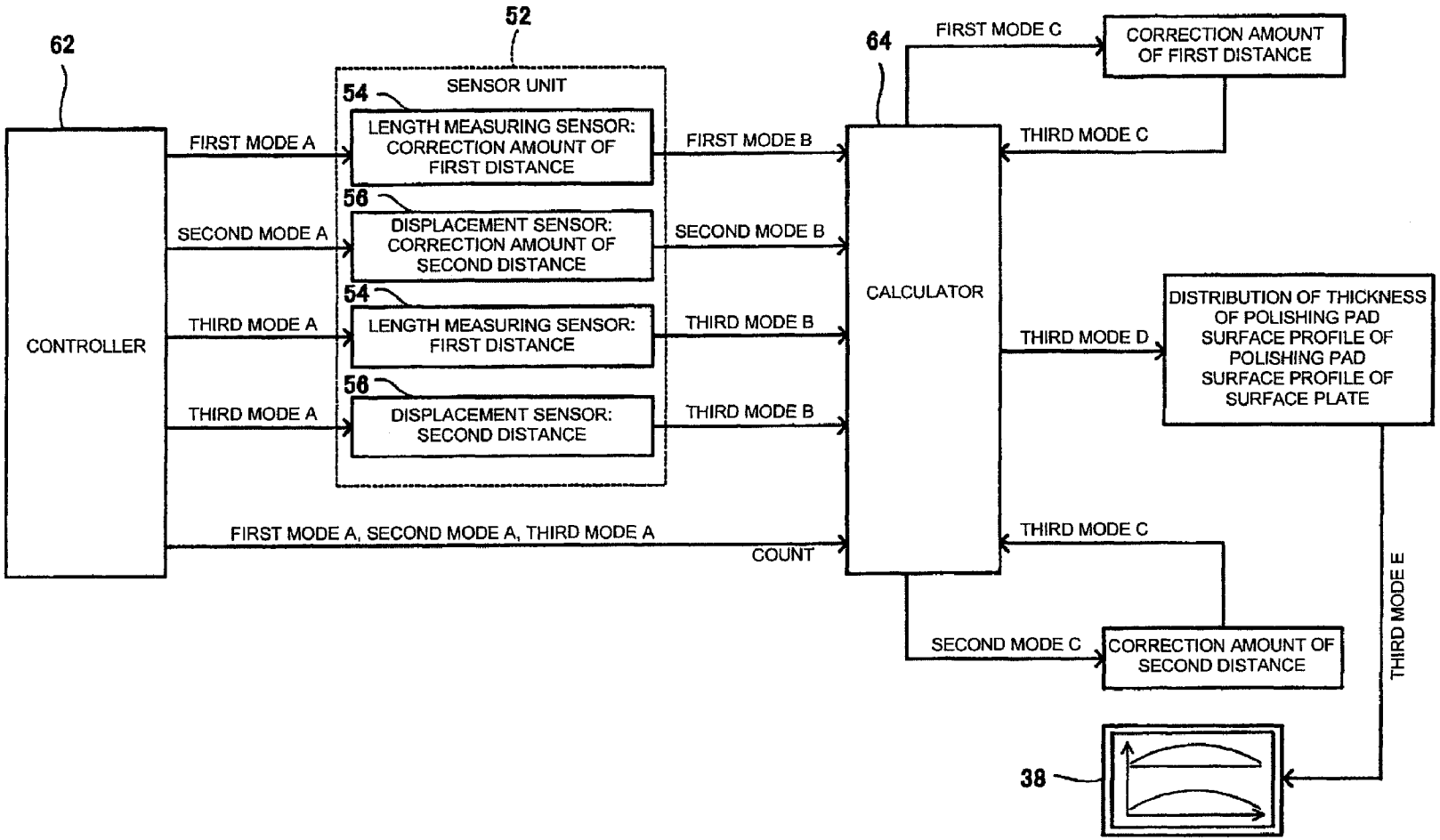
FIG. 5 is a control block diagram of the polishing pad thickness measuring device according to the second embodiment.

A polishing pad thickness measuring device 50 and a polishing pad thickness measuring method according to a second embodiment are illustrated in FIG. 4 and the control block diagram of the polishing pad thickness measuring device is illustrated in FIG. 5. The polishing pad thickness measuring method according to the second embodiment measures the thickness of a polishing pad while horizontally moving distance measurement points 84 and 86 (see FIG. 1D) in one direction on the polishing pad.

Accordingly, the polishing pad thickness measuring device 50 according to the second embodiment, which embodies this method, includes one sensor unit 52 (a set of a length measuring sensor 54 and a displacement sensor 56) that slides in the longitudinal direction of a rail part 58 and measures first and second distances 90 and 94 for each predetermined position. Therefore, an actuator (not shown) such as a stepping motor, which can slide on the rail part 58, is fixed to the sensor unit 52, and it is possible to drive the actuator by a predetermined amount by a control unit 60.

If an initial position and a moving width of the sensor unit 52 are input to a controller 62 by the operation of keys, the controller 62 may output signals, which move the sensor unit 52 by a predetermined moving width, to the control unit 60 at regular time intervals and may output signals that operate the length measuring sensor 54 and the displacement sensor 56 after the sensor unit 52 is moved by a predetermined moving width. If the signals, which operate the sensor unit 52 by a predetermined moving width, are input to the control unit 60, the control unit 60 outputs electric power that drives the actuator (not shown) by a predetermined amount and outputs electric power that operates the length measuring sensor 54 and the displacement sensor 56 after the driving of the actuator (not shown). Accordingly, the sensor unit 52 may measure the first and second distances 98 and 100 at regular time intervals in a movable range on the rail part 58.

Further, the controller 62 has a first mode that operates only the length measuring sensor 54 while sequentially moving the sensor unit 52 by a predetermined moving width, a second mode that operates only the displacement sensor 56, and a third mode that operates both the length measuring sensor 54 and the displacement sensor 56. These modes may be selected by the operation of the keys. The first mode is used to calculate the correction amount 92 of the first distance by placing the polishing pad thickness measuring device 50 on the stone surface plate 40, the second mode is used to calculate the correction amount 96 of the second distance by placing the calibration SUS plate 42 on the stone surface plate 40 and placing the polishing pad thickness measuring device 50 on the calibration SUS plate, and the third mode is used to measure the thickness of the polishing pad 14 and the surface profiles of the polishing pad 14 and the surface plate 12. A calculator 64 to be described below operates so as to correspond to these modes.

If the initial position and the moving width of the sensor unit 52 are input by the operation of keys, the calculator 64 may count the number of times of the movement of the sensor unit 52 whenever the controller 62 outputs signals for moving the sensor unit 52 and may calculate the measurement position of the sensor unit 52 corresponding to a count value.

If the first mode is selected, the controller 62 outputs signals for moving the sensor unit 52 by a predetermined distance and outputs signals for operating the length measuring sensor 54 after the movement of the sensor unit (first mode A). Then, the length measuring sensor 54 outputs signals, which correspond to the correction amount 92 of the first distance of which an object to be measured is the stone surface plate 40, to the calculator 64 (first mode B). The calculator 64 counts the number of times of the movement of the sensor unit (first mode A), and stores the correction amount 92 of the first distance, which corresponds to a count value, in the memory area of the PC 24 (first mode C).

If the second mode is selected, the controller 62 outputs signals for moving the sensor unit 52 by a predetermined distance and outputs signals for operating the displacement sensor 56 after the movement of the sensor unit (second mode A). Then, the displacement sensor 56 outputs signals, which correspond to the correction amount 96 of the second distance of which an object to be measured is the calibration SUS plate 42, to the calculator 64 (second mode B). The calculator 64 counts the number of times of the movement of the sensor unit 52 (second mode A), and stores the correction amount 96 of the second distance, which corresponds to a count value, in the memory area of the PC 24 (second mode C).

If the third mode is selected, the controller 62 outputs signals for moving the sensor unit 52 by a predetermined distance and outputs signals for operating the length measuring sensor 54 and the displacement sensor 56 after the movement of the sensor unit (third mode A). Then, the length measuring sensor 54 outputs signals, which correspond to the first distance 90 of which an object to be measured is the polishing pad 14, to the calculator 64 (third mode B) and the displacement sensor 56 outputs signals, which correspond to the second distance 94 of which an object to be measured is the surface plate 12, to the calculator 64 (third mode B). The calculator 64 counts the number of times of the movement of the sensor unit 52 (third mode A), reads the correction amount 96 of the first and second distances corresponding to count values stored in the memory area of the PC 24 (third mode C), calculates the corrected (zero-corrected) first distances 98 (second distances 100) by subtracting the correction amounts 92 (96) of the first distances (second distances) from the first distances 90 (second distances 94) (third mode D), calculates the thickness of the polishing pad 14 from the difference between the corrected first and second distances 98 and 100 (third mode D), and displays both the corrected first distances 98 (the surface profile of the polishing pad 14) and the corrected second distances 100 (the surface profile of the surface plate 12) on the display 38 of the PC 24 (third mode E).

Accordingly, the operator can visually recognize the surface profiles of the polishing pad 14 and the surface plate 12 and the distribution of the thickness of the polishing pad 14 by performing the above-mentioned processing of the controller 62 and the calculator 64 with respect to all count values. Meanwhile, the resolution of the distribution of the thickness and the profiles is improved by reducing a moving distance. Further, the count value, the measurement position of the polishing pad 14 corresponding to the count value, the corrected first distance 98, the corrected second distance 100, and the thickness of the polishing pad 14 are stored as measurement data in the memory area of the PC 24 by the calculator 64. The calculator 64 may read the measurement data as needed.

Figure 6:
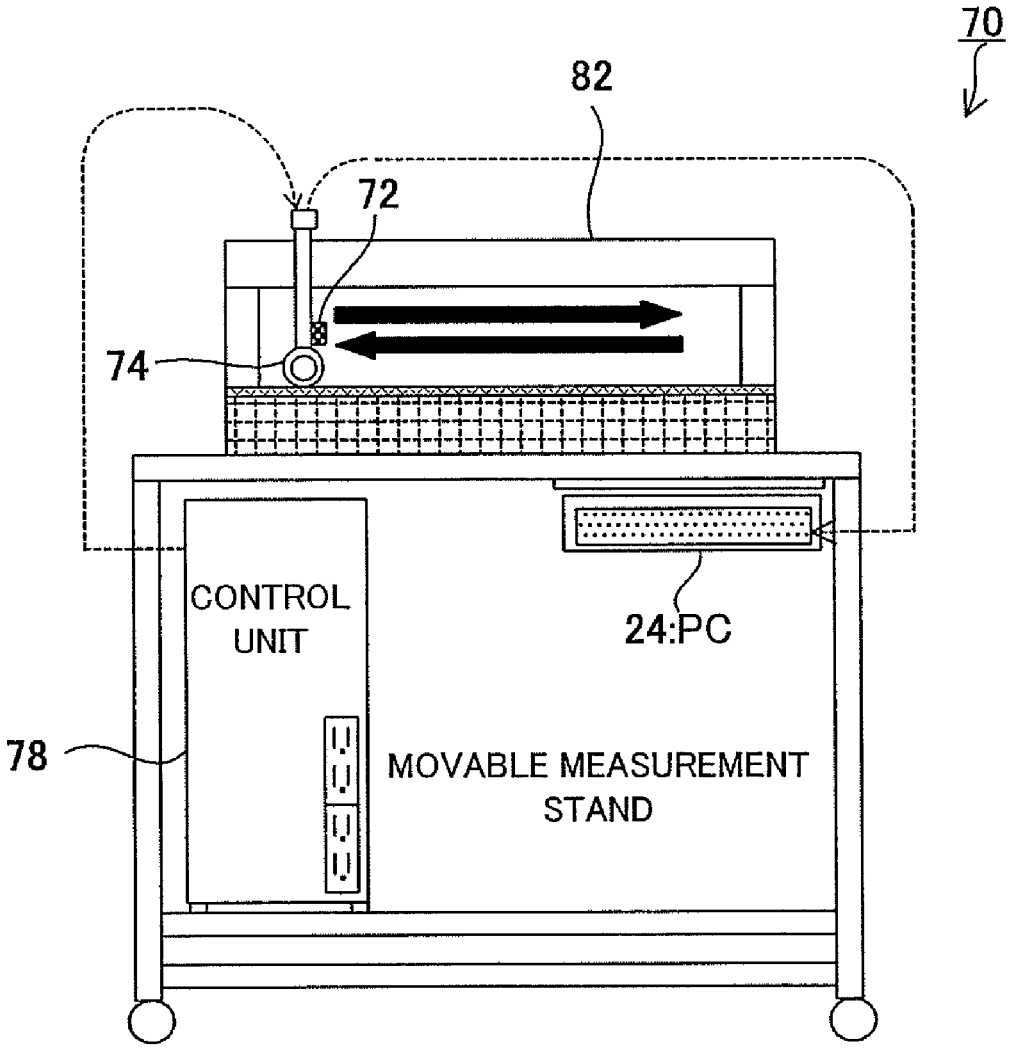
FIG. 6 is a view schematically illustrating a polishing pad thickness measuring device according to a third embodiment.
Figure 7:
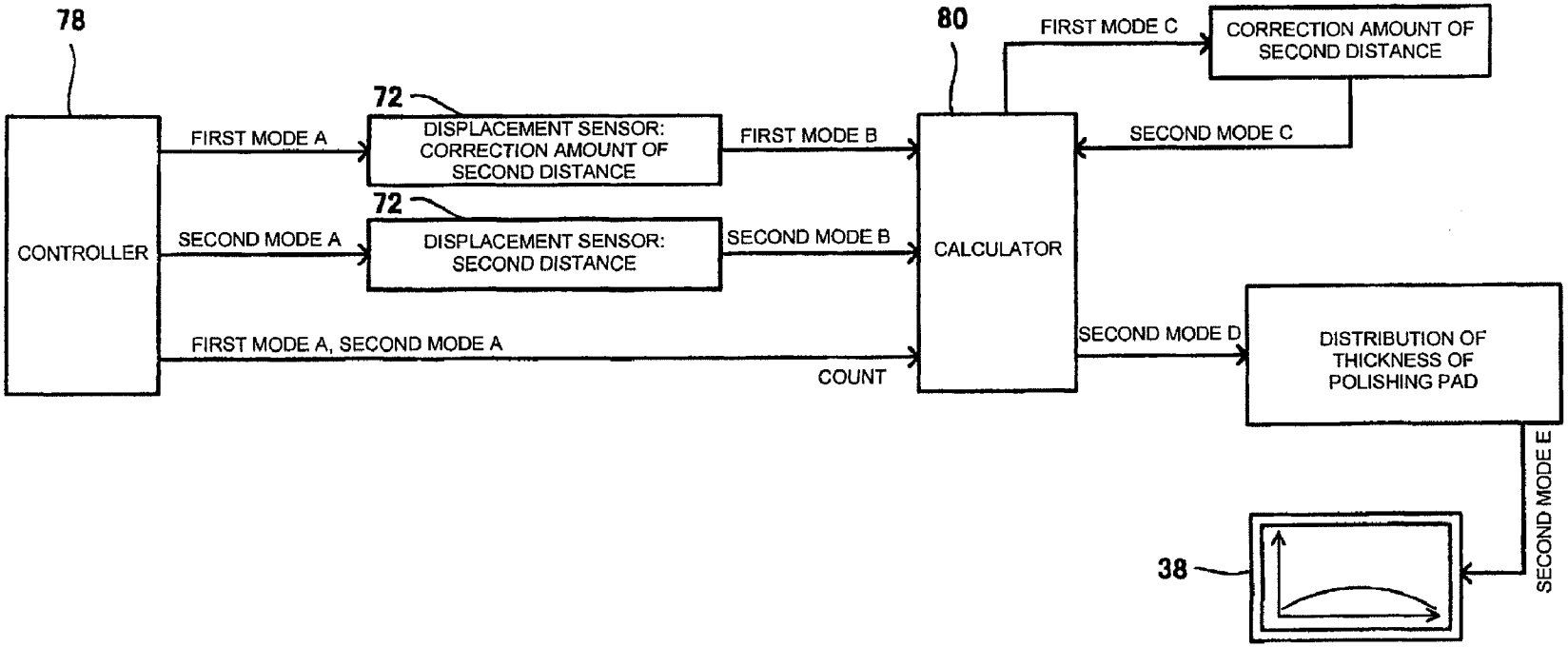
FIG. 7 is a control block diagram of the polishing pad thickness measuring device according to the third embodiment.

A polishing pad thickness measuring device 70 and a polishing pad thickness measuring method according to a third embodiment are illustrated in FIG. 6 and the control block diagram of the polishing pad thickness measuring device is illustrated in FIG. 7. The polishing pad thickness measuring method according to the third embodiment measures the second distance 100 (see FIG. 1D) while making the displacement sensor come into contact with the upper surface of the polishing pad. Accordingly, the polishing pad thickness measuring device 70 according to the third embodiment, which embodies this method, is basically similar to the polishing pad thickness measuring device according to the second embodiment. However, the polishing pad thickness measuring device 70 measures the second distance 100 while making a displacement sensor 72 come into contact with the surface of the polishing pad 14. Actually, a wheel 74 is provided at the lower end of a member that forms the displacement sensor 72 and a sensor head (not shown) of the displacement sensor 72 is positioned at a predetermined height. Accordingly, a distance between the sensor head (not shown) and the polishing pad 14 is always constant.

If an initial position and a moving width of the displacement sensor 72 are input to a controller 76 by the operation of keys, the controller 76 may output signals, which move the displacement sensor 72 by a predetermined moving width, to a control unit 78 at predetermined time intervals and may output signals that operate the displacement sensor 72 after the displacement sensor is moved by a predetermined moving width. If the signals, which move the displacement sensor 72 by a predetermined moving width, are input to the control unit 78, the control unit 78 outputs electric power that drives the actuator (not shown) by a predetermined amount and outputs electric power that operates the displacement sensor 72 after the driving of the actuator (not shown).

A calculator 80 may count the number of times of the movement of the displacement sensor 72 whenever the controller 76 outputs signals for moving the displacement sensor 72 and may calculate the measurement position of the displacement sensor corresponding to a count value. Further, the calculator 80 has first and second modes, and the modes may be selected by the operation of the keys.

If the first mode is selected, the controller 76 outputs signals for moving the displacement sensor 72 by a predetermined distance and outputs signals for operating the displacement sensor 72 after the movement of the displacement sensor (first mode A). Then, the displacement sensor 72 outputs signals, which correspond to the correction amount 96 of the second distance of which an object to be measured is the stone surface plate 40, to the calculator 80 (first mode B). The calculator 80 counts the number of times of the movement of the displacement sensor 72 (first mode A), and stores the correction amount 96 of the second distance, which corresponds to a count value, in the memory area of the PC 24 (first mode C).

If the second mode is selected, the controller 76 outputs signals for moving the displacement sensor 72 by a predetermined distance and outputs signals for operating the displacement sensor 72 after the movement of the displacement sensor (second mode A). Then, the displacement sensor 72 outputs signals, which correspond to the second distance 94 of which an object to be measured is the surface plate 12, to the calculator 80 (second mode B). The calculator 80 counts the number of times of the movement of the displacement sensor 72 (second mode A), reads the correction amount 96 of the second distance corresponding to a count value (second mode C), calculates the corrected (zero-corrected) second distance 100 as the thickness of the polishing pad 14 by subtracting the correction amount 96 of the second distance from the second distance 94 (second mode D), and displays the corrected (zero-corrected) second distance on the display 38 of the PC 24 (second mode E). Meanwhile, the count value, the measurement position of the polishing pad 14 corresponding to the count value, the corrected second distance 100, and the thickness of the polishing pad 14 are stored as measurement data in the memory area of the PC 24. The calculator 80 may read the measurement data as needed.

Meanwhile, the correction amount 96 of the second distance in this embodiment is equal to the correction amount 96 of the second distance in the first and second embodiments. The technical idea of this embodiment is also the same as those of the first and second embodiments in that the thickness of the polishing pad 14 is measured by the difference between the first and second distances 98 and 100. It is not possible to measure the surface profiles of the polishing pad 14 and the surface plate 12 in this embodiment. However, it is possible to more easily measure the thickness of the polishing pad 14 than in the second embodiment. Further, a length measuring sensor is not required in this embodiment.

The devices according to the first and second embodiments are non-contact type devices where the length measuring sensors 30 and 54 do not come into contact with the polishing pad. Accordingly, even though grooves are formed on the polishing pad 14, it is possible to measure the surface profile of the polishing pad 14. Meanwhile, the length measuring sensors 30 and 54 may be contact type sensors that come into contact with the polishing pad 14. The contact type device has, for example, the structure in which the lower end of the length measuring sensor comes into contact with the polishing pad, the length measuring sensor is moved up and down according to the change of the height of the polishing pad, and the moving distance of the length measuring sensor is detected. When moisture exists on the surface of the polishing pad 14, the contact type device may measure the surface profile of the polishing pad more accurately than the non-contact type device due to this structure. However, if grooves are formed on the polishing pad, it is difficult to measure the surface profile of the polishing pad by the contact type device. Meanwhile, if grooves are formed on the polishing pad 14 in the third embodiment, it is difficult to measure the thickness of the polishing pad 14.

As described above, the polishing pad thickness measuring methods and the polishing pad thickness measuring devices 10, 50, and 70 according to the embodiments calculate the thickness of the polishing pad 14 by the difference between the first distance 98 (between the reference position 88 and the upper surface of the polishing pad 14 attached to the surface plate 12) and the second distance 100 (between the reference position 88 and the upper surface of the surface plate 12). Accordingly, it is possible to measure the thickness of the polishing pad 14 in a nondestructive manner, so that it is possible to perform dressing effectively by using the result of the measurement.

Further, the distance measurement points 84 and 86 of the first and second distances 90 and 94 are set above the reference planes having a predetermined flatness (the reference planes of the stone surface plate 40 and the calibration SUS plate 42, the reference positions 88), respectively, and the distances between the reference plane and the distance measurement points 84 and 86 are calculated as the correction amounts 92 and 94. The reference positions are positioned at the heights obtained by subtracting the corresponding correction amounts 92 and 94 from the heights of the distance measurement points 84 and 86, and the measurement of the first and second distances 98 and 100 is based on the reference positions 88 (the reference planes of the stone surface plate 40 and the calibration SUS plate 42) having a predetermined flatness. Accordingly, it is possible to measure the distances between the reference position 88 and the polishing pad 14 and the surface plate 12 without the influence of the heights of the distance measurement points 84 and 86, so that it is possible to measure the thickness of the polishing pad 14.

Further, since the measurement of the second distance 100 is performed using the eddy current displacement sensors 32, 56, and 72, it is possible to reliably measure the distance between the reference position and the upper surface of the surface plate 12 made of metal, without the influence of the polishing pad 14 that is an insulator.

As shown in the first embodiment, plural length measuring sensors 30 and displacement sensors 32 are provided above the polishing pad 14 in one direction and plural distance measurement points 84 and 86 are set. Accordingly, it is possible to easily perform measurement at plural points and to perform measurement in a short time. Further, it is possible to grasp not only the distribution of the thickness of the polishing pad 14 in one direction but also the surface profiles of the polishing pad 14 and the surface plate 12 in detail by reducing the interval between the distance measurement points 84 and 86.

As shown in the second embodiment, the first and second distances 98 and 100 are measured while the polishing pad 14 is scanned in one direction by the length measuring sensor 54 and the displacement sensor 56. Accordingly, it is possible to grasp the distribution of the thickness of the polishing pad 14 and the surface profiles of the polishing pad 14 and the surface plate 12 in detail by a set of the length measuring sensor 54 and the displacement sensor. Therefore, it is possible to reduce the manufacturing cost.

As shown in the third embodiment, the surface of the polishing pad 14 is scanned while the displacement sensor 72 comes into contact with the surface of the polishing pad 14. Accordingly, it is possible to measure the thickness of the polishing pad even though the length measuring sensor is not used.

From the above description, the embodiments may be used to measure the thickness of the polishing pad in a nondestructive manner, and may be used as a polishing pad thickness measuring method and a polishing pad thickness measuring device that measure the surface profiles of the polishing pad and the surface plate.

What is claimed is:

1. A polishing pad thickness measuring method that measures a thickness of a polishing pad attached to an upper surface of a surface plate, the method comprising:

measuring a first distance between an upper surface of the polishing pad and a reference position on a vertical line perpendicular to the surface of the polishing pad and a second distance between an upper surface of the surface plate and the reference position on the vertical line; and calculating the thickness of the polishing pad from a difference between the first and second distances.

2. The polishing pad thickness measuring method according to claim 1, wherein the measurement of the second distance is performed by an eddy current displacement sensor.

3. The polishing pad thickness measuring method according to claim 1, wherein the measurement of the first and second distances is performed by setting a plurality of distance measurement points in one direction above the polishing pad.

4. The polishing pad thickness measuring method according to claim 1, wherein the measurement of the first and second distances is performed while distance measurement points are moved horizontally in one direction on the polishing pad.

5. The polishing pad thickness measuring method according to claim 1, wherein the measurement of the second distance is performed while a displacement sensor for measuring the second distance comes into contact with the upper surface of the polishing pad and is moved horizontally in one direction on the polishing pad.

6. A polishing pad thickness measuring method that measures a thickness of a polishing pad attached to an upper surface of a surface plate, the method comprising:

measuring a first distance between an upper surface of the polishing pad and a reference position on a vertical line perpendicular to the surface of the polishing pad and a second distance between an upper surface of the surface plate and the reference position on the vertical line; and calculating the thickness of the polishing pad from a difference between the first and second distances, wherein distance measurement points of the first and second distances are set above reference planes having a predetermined flatness, respectively, and distances between the reference plane and the distance measurement points are calculated as correction amounts, and the reference position is positioned at a height obtained by subtracting the corresponding correction amount from the height of each of the distance measurement points.

7. The polishing pad thickness measuring method according to claim 6, wherein the measurement of the second distance is performed by an eddy current displacement sensor.

8. The polishing pad thickness measuring method according to claim 6, wherein the measurement of the first and second distances is performed by setting a plurality of distance measurement points in one direction above the polishing pad.

9. The polishing pad thickness measuring method according to claim 6, wherein the measurement of the first and second distances is performed while distance measurement points are moved horizontally in one direction on the polishing pad.

10. The polishing pad thickness measuring method according to claim 6, wherein the measurement of the second distance is performed while a displacement sensor for measuring the second distance comes into contact with the upper surface of the polishing pad and is moved horizontally in one direction on the polishing pad.

11. A polishing pad thickness measuring device that measures a thickness of a polishing pad attached to an upper surface of a surface plate, the device comprising:

a length measuring sensor which measures a first distance between an upper surface of the polishing pad and a reference position on a vertical line perpendicular to the surface of the polishing pad;

a displacement sensor which measures a second distance between an upper surface of the surface plate and the reference position;

a controller that is connected to the length measuring sensor and the displacement sensor and outputs signals for operating the length measuring sensor and the displacement sensor; and a calculator that is connected to the length measuring sensor and the displacement sensor and calculates the thickness of the polishing pad from a difference between the first and second distances.

12. The polishing pad thickness measuring device according to claim 11, wherein the displacement sensor is an eddy current displacement sensor.

13. The polishing pad thickness measuring device according to claim 11, wherein a plurality of the length measuring sensors and the displacement sensors are provided in one direction above the polishing pad.

14. The polishing pad thickness measuring device according to claim 11, wherein the length measuring sensor and the displacement sensor are slidably mounted on a rail that has a predetermined height in a longitudinal direction and is horizontal above the polishing pad, and the controller outputs signals that make the length measuring sensor and the displacement sensor slide, and signals that operate the length measuring sensor and the displacement sensor.

15. The polishing pad thickness measuring device according to claim 11, wherein the displacement sensor measures the second distance while coming into contact with the upper surface of the polishing pad.

16. A polishing pad thickness measuring device that measures a thickness of a polishing pad attached to an upper surface of a surface plate, the device comprising:

a length measuring sensor which measures a first distance between an upper surface of the polishing pad and a reference position on a vertical line perpendicular to the surface of the polishing pad;

a displacement sensor which measures a second distance between an upper surface of the surface plate and the reference position;

a controller that is connected to the length measuring sensor and the displacement sensor and outputs signals for operating the length measuring sensor and the displacement sensor; and a calculator that is connected to the length measuring sensor and the displacement sensor and calculates the thickness of the polishing pad from a difference between the first and second distances, wherein distance measurement points of the first and second distances are set above reference planes having a predetermined flatness, respectively, and distances between the reference plane and the distance measurement points are calculated as correction amounts, and the reference position is positioned at a height obtained by subtracting the corresponding correction amount from the height of each of the distance measurement points.

17. The polishing pad thickness measuring device according to claim 16, wherein the displacement sensor is an eddy current displacement sensor.

18. The polishing pad thickness measuring device according to claim 16, wherein a plurality of the length measuring sensors and the displacement sensors are provided in one direction above the polishing pad.

19. The polishing pad thickness measuring device according to claim 16, wherein the length measuring sensor and the displacement sensor are slidably mounted on a rail that has a predetermined height in a longitudinal direction and is horizontal above the polishing pad, and the controller outputs signals that make the length measuring sensor and the displacement sensor slide, and signals that operate the length measuring sensor and the displacement sensor.

20. The polishing pad thickness measuring device according to claim 16, wherein the displacement sensor measures the second distance while coming into contact with the upper surface of the polishing pad.

* * * * *